United States Patent [19]

Pfalzgraf et al.

[11] Patent Number: 4,506,642

[45] Date of Patent: Mar. 26, 1985

[54] ELECTRIC GAS PEDAL

[75] Inventors: Manfred Pfalzgraf, Birstein; Kurt Probst, Schwalbach, both of Fed. Rep. of Germany

[73] Assignee: VDO Adolf Schindling AG, Frankfurt am Main, Fed. Rep. of Germany

[21] Appl. No.: 427,394

[22] Filed: Sep. 29, 1982

[30] Foreign Application Priority Data

Dec. 12, 1981 [DE] Fed. Rep. of Germany ..... 3149361

[51] Int. Cl.[3] ..... F02D 11/10

[52] U.S. Cl. ..... 123/361; 123/399; 123/339; 251/131; 180/179

[58] Field of Search ..... 123/361, 339, 399, 396; 180/179, 271, 281, 272; 251/131

[56] References Cited

U.S. PATENT DOCUMENTS

| | | | |
|---|---|---|---|
| 3,752,187 | 8/1973 | Marr | 251/131 |
| 4,112,885 | 9/1978 | Iwata | 123/399 |
| 4,163,432 | 8/1979 | Hertfelder | 123/361 |
| 4,367,805 | 1/1983 | Totani | 180/179 |
| 4,392,468 | 7/1983 | Kobashi | 123/361 |
| 4,419,973 | 12/1983 | Colonia | 123/399 |

*Primary Examiner*—Ronald B. Cox

*Attorney, Agent, or Firm*—Martin A. Farber

[57] ABSTRACT

The invention relates to an electric gas pedal for automotive vehicles having a desired-value transmitter 1 from which a desired-value signal can be fed to an electronic controller unit 3. The controller unit 3 controls by means of electric signals a setting member 4 which controls the motor power via a displacement device. In order to make optimum adjustment of this electric gas pedal possible in a simple and economical manner, the actual setting range possible for the displacement device is determined and stored as effective desired setting range of the controller unit 3 in the latter.

15 Claims, 2 Drawing Figures

ELECTRIC GAS PEDAL

Figure 1:
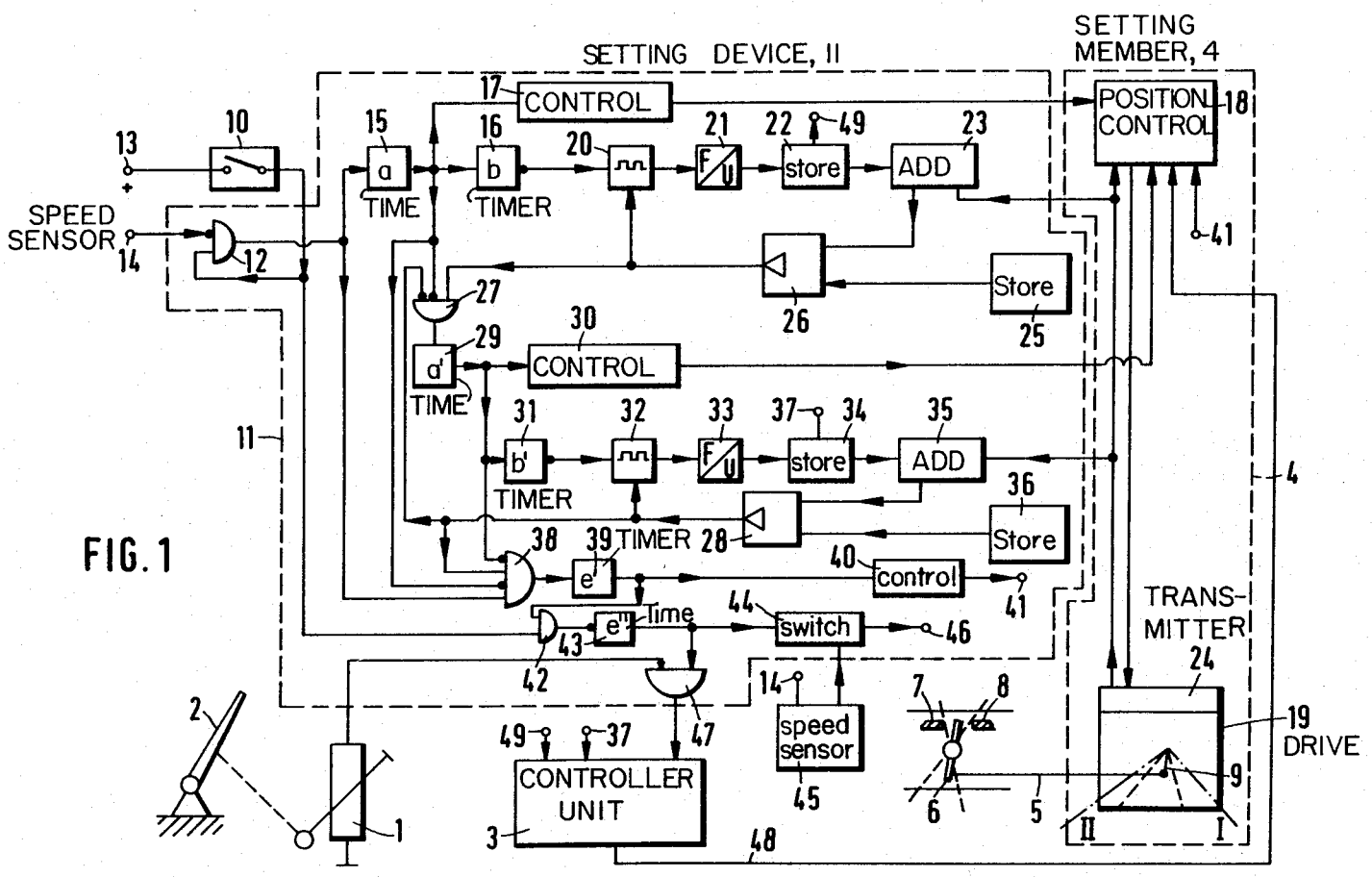

The present invention relates to an electric gas pedal for automotive vehicles having a desired-value transmitter from which an electric desired-value signal can be fed to an electronic controller unit, having a setting member which is controllable by electric signals of the controller unit and can be displaced within a maximum possible desired setting range limited by a first and a second end position, by which setting member a displacement device displaceable within an actual setting range limited by a first end position and a second end position can be mechanically actuated via a transmission unit for the control of the motor power.

Such an electric gas pedal is known. If such a pedal is installed in an automotive vehicle or if parts and particularly mechanical transmission parts are replaced on a unit which is already installed then a manual adjustment of the entire unit is always necessary as a result of the manufacturing tolerances. This is true even if no optimum adjustment exists any longer due to changes in clearance after lengthy use.

This adjustment requires a large amount of labor and is very expensive.

The object of the present invention is therefore to provide an electric gas pedal in accordance with the foregoing description which permits of optimum adjustment in a simple and economical manner.

This object is achieved in accordance with the invention in the manner that the maximum possible desired setting range is greater than the actual setting range and that in the first end position and in the second end position of the displacement device the position of the setting member (4) can in each case be detected by a setting device (11) and be stored as effective desired setting range in the controller unit (3). In this way all mechanical adjustment work can be dispensed with entirely since in the completely installed unit the lower and upper end positions actually present on the displacement device are fixed and programmed as effective desired setting range in the controller unit. The controller unit then operates in all cases only in the effective desired setting range.

All tolerances of any nature whatsoever are completely detected and taken into account upon the adjustment. It makes no difference in this connection whether the displacement device is formed by a throttle valve or a variable displacement pump.

The setting member (4) can consist of an electric motor which is mechanically connected with the displacement device and of an actual-value transmitter (24) which produces an electric signal corresponding to the instantaneous position of the displacement device.

The adjustment can be effected in a simple manner, utilizing the structural parts traditionally already present, in the manner that the electric motor can be driven into the one end position of the displacement device and the signal corresponding to this end position produced by the actual-value transmitter (24), and that thereupon the electric motor can be driven into the second end position of the displacement device and an electric signal corresponding to this end position can be produced by the actual value transmitter (24). This is true also when the actual value transmitter (24) is a potentiometer and the electric signal is a voltage signal.

The detection and storage of the effective desired setting range can be effected within a given setting time (A).

The latter consists preferably of a lower setting time (a) for the detection and storage of the first end position and of an upper setting time (a') for the detection and storage of the second end position.

In order that the setting member does not remain in a full-gas position after an adjustment process, the setting time (A) can contain a starting time (e') following the upper setting time (a') and a resetting time (e'') for returning the electric motor into its lower end position. In this way the setting member is first displaced into its idle position before an effective control can be effected from the desired value transmitter.

The electric motor can be driven into the first or second end position for a time which corresponds at least to the maximum required displacement time (b or b') for the displacement of the setting member (4) from one end position into the other end position (I and II). In this way assurance is had that with all conceivable tolerances and from any conceivable position of the displacement device the electric motor actually travels into its two absolute end positions before the displacement device is stopped.

After the maximum required displacement time (b or b') of the setting member (4) during a counting time, the electric signal corresponding to the corresponding end position can be produced. In order in all cases to conclude the counting process and not interrupt it, the counting time may consist of an effective counting time (c or c') and a safety time (d or d') and the counting time may be greater than the maximum possible effective counting time (c or c').

The setting device can, for instance, be a stationary device which can be connected for adjustment to corresponding terminals of the controller unit. Such a stationary device can then be present at the car manufacturer as well as at repair shops.

It is simpler, however, if the setting device (11) is arranged fixed in the vehicle and is connected to the desired-value transmitter (1) and the electric controller unit (3). Since only an integrated circuit is necessary in addition to the traditional system, this requires only a small amount of installation space.

If in this connection the setting device (11) can be connected by the ignition switch (10) of the vehicle, an adjustment, which can be concluded within one to two seconds, is automatically effected upon each starting process.

In order to avoid danger in traffic, the possibility of connecting the setting device (11) during operation of the motor can, preferably, be blocked.

During the setting time of the setting device (11) the controllability of the electronic controller unit (3) can be blocked by the desired value transmitter (1). Similarly, the connectability of the starter (46) for the motor of the automotive vehicle can preferably be blocked during the setting time.

Figure 2:
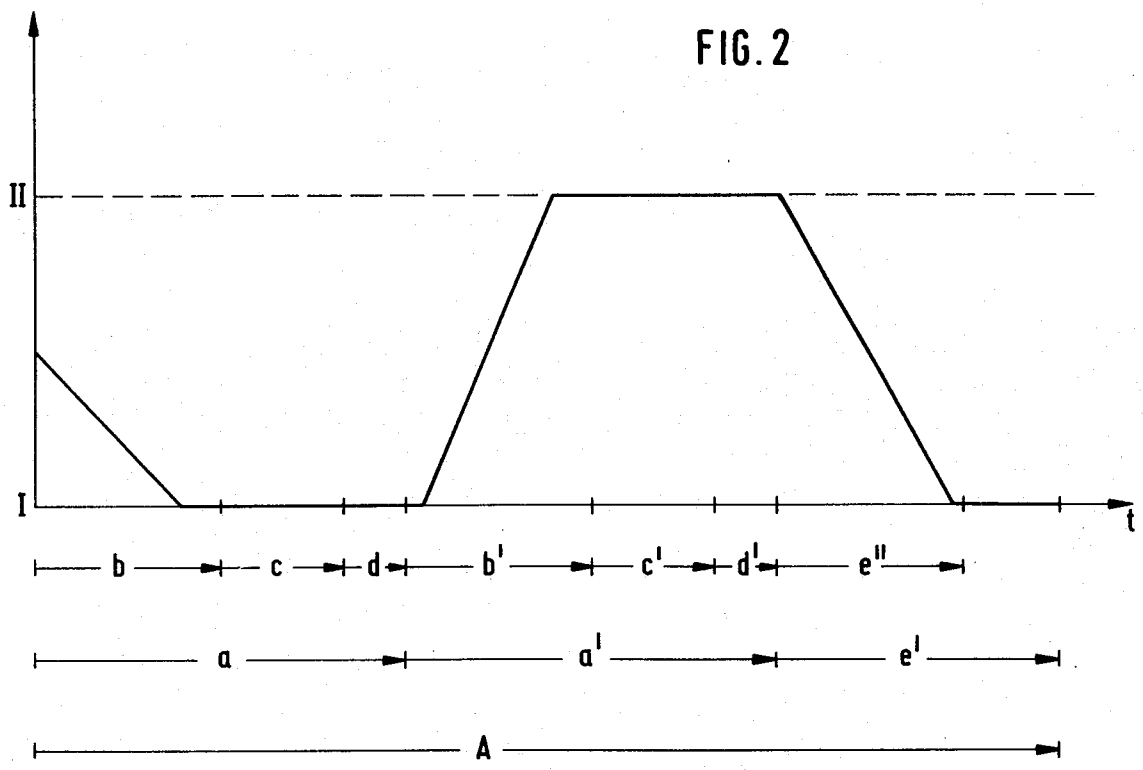

One preferred embodiment of the invention is described further below and shown in the drawing, in which FIG. 1 is a block diagram of an electric gas pedal in accordance with the invention, and FIG. 2 is a diagram of the operation of the electric gas pedal of FIG. 1.

In FIG. 1, a desired-value transmitter 1 developed as potentiometer is displaceable by a gas pedal 2. From the desired-value transmitter 1 an electric desired-value signal can be fed to an electronic controller unit 3. Corresponding to the instantaneous electric desired-value signal, the controller unit 3 controls a setting member 4 by which, via a transmission unit 5, a displacement device can be mechanically actuated to control the motor power. In the embodiment shown the displacement device is a throttle valve 6.

The throttle valve 6 is swingable within an actual-setting range the first end position of which is fixed by a stop 7 while its second end position is fixed by a stop 8.

The swing lever 9 of the setting member 4, which lever drives the transmission unit 5, can be displaced within a desired setting range between a first end position I and a second end position II, these positions being shown in dot-dash line. In this connection, this maximum possible desired setting range is greater than the actual setting range of the throttle valve 6. This actual setting range is shown by interrupted lines both on the throttle valve 6 and on the swing lever 9. In this connection the desired setting range of the swing lever 9, which is represented by the dash-dot lines, is so large that even when taking into consideration all possible tolerances on swing lever 9, transmission unit 5, throttle valve 6 as well as stops 7 and 8, the swing range of the swing lever 9, represented by the interrupted line, is always within the desired setting range shown in dash-dot line.

In FIG. 1 an ignition switch 10 is also present as well as a setting device 11 surrounded by an interrupted line.

Via the ignition switch 10 the one input of an AND member 12 can be connected to the positive terminal 13 of a battery. The second input of the AND member 12 is negated and connected with a motor-speed sensor 14. If the motor speed is zero, then a signal is present on the AND member 12 from the motor-speed sensor 14 due to the negation. If the ignition switch 10 is also closed, the AND member 12 gives off an output signal which is fed to a time member 15.

The time member 15 controls a further time member 16 as well as a control unit 17 for a lower setting time a. From the control unit 17 a position controller 18 of the setting member 4 is then controlled, it driving the drive 19 of the setting member 4 in the direction towards its first end position I.

Due to the negation of its output, the time member 16 controlled by time member 15 forwards a signal to a pulse counter 20 only after the end of a displacement time b which corresponds at least to the maximum required displacement time for the displacement of the setting member 4 from the second end position II into the first end position I. The frequency of the pulses of said pulse counter is converted within a frequency/voltage converter 21 into a voltage and stored in a correction storage 22. The correction storage 22 then forwards its storage value to an adder 23. A further value is also fed to this adder 23 and added to the stored value. This further value is supplied by a transmitter 24 of the setting member 4 and corresponds to the distance from the second end position II to the position in which the setting member 4 can be moved closest to the first end position I.

Since this value is already present at the adder 23 before the latter receives storage values from the correction storage, the storage values are added to the value already present. This process continues until the output value of the adder 23 corresponds to the value which represents the total displacement path between the first end position I and the second end position II of the setting member 4.

This total value is stored as fixed value in a fixed-value storage 25 and is present at the one input of a comparator 26. If the output value of the adder 23 present on the second input of the comparator reaches the value of the fixed-value storage 25, the comparator 26 gives off a signal.

This signal acts on the pulse counter 20 and stops the latter.

Thus the final storage value of the correction storage 22 is also fixed and is fed from the correction storage via a connection 49 to the electronic controller unit 3 and stored there as lower end position of the effective desired setting range.

The output signal of the comparator 26 is fed also to an input of an AND member 27.

A second negated input of the AND member 27 is connected to the output of a comparator 28 which has the same function as the comparator 26 and still does not give off any signal at this time.

The output of the time member 15 is connected to a third negated input of the AND member 27.

After the expiration of the setting time a, the time member 15 no longer gives off a signal so that then no signals are present at the two negated inputs of the AND member 27 and a signal is present from the comparator 26.

Thus the AND member 27 gives off a signal and places a time member 29 in operation for a setting time a'.

In the same way and for the same function as in the case of the time member 15, a control unit 30 and a time member 31 are connected to the time member 29. Due to the control unit 30 the position regulator 18 of the setting member 4 is then controlled and drives the drive 19 of the setting member 4 in the direction of its second end position II.

By the negation of its output, the time member 31, in the same way as the time member 16, gives off an output signal to a pulse counter 32 only after a displacement time b'. This pulse counter 32, a correction storage 34 which is connected thereto via a frequency/voltage converter 33, and an adder 35 operate with a fixed-value storage 36 and the comparator 28 in the same manner as pulse counter 20, frequency/voltage converter 21, correction storage 22, adder 23, fixed value storage 25 and comparator 26. The value thereby determined on the correction storage 34 is fed via the connection 37 to the electronic controller unit 3 and stored there as upper end position of the effective desired setting range.

The output signal of the comparator 28, however, not only stops the pulse counter 32 but also acts on the one negated input of the AND member 27 so that the latter is blocked.

Furthermore, the output signal of the comparator 28 is also present on one input of an AND member 38.

A second input of the AND member 38 is connected with the output of the AND member 12, a third negated input is connected with the output of the time member 15, and a fourth, also negated input is connected with the output of the time member 29.

This has the result that after the expiration of the setting time a' after which the time member 29 no longer gives off a signal, the AND member 38 gives off an output signal.

A time member 39 is controlled by the latter. For a start time e' the time member 39 gives a signal to a control unit 40 whose output 41 so controls the position controller that the setting member 4 moves into its lower end position determined by the correction storage 22. This position corresponds to the idle position of the desired-value transmitter 1.

One input of an AND member 42 is acted on by the output signal of the time member 39. The second input of the AND member 42 is connected with the ignition switch 10 and thus acted on by a signal.

A signal is also given off from the AND member 42 by the output signal of the time member 39 and fed to a time member 43 whose input is negated.

The time member 43 does not give off an output signal for a reset time e''.

This reset time e'' is shorter than the starting time e'. However, it is so long that before its termination the setting member 4 has definitely moved into the lower end position.

After the expiration of the reset time e'', the time member 43 gives off a signal to a start blocking switch 44. The start blocking switch 44 receives a further signal from a motor-speed sensor 45 at a speed of zero and when these two signals are present connects a starter 46 of the motor so that the latter is started.

As soon as the motor is operating, the start switch 44 receives a signal of an existing motor speed from the motor-speed sensor 45 and disconnects the starter 46. One input of an AND member 47 is also acted on by the output signal of the time member 43.

In this way the signal of the desired-value transmitter 1 which is present at the second input of the AND member 47 and has been blocked up to now is fed via the output of the AND member 47 to the electronic controller unit 3. The latter now in traditional manner, via its output 48 which leads to the setting member 4, starts said setting member 4.

By the storage values introduced at the connections 37 and 49 the effective desired setting range is stored in the controller unit, which range corresponds precisely to the actual setting range present at the drive 19 of the displacement device for the controlling of the motor power. Thus upon each starting process a new adjustment of the stop of the electric gas pedal takes place. A separate manual adjustment is no longer necessary upon the installation of such a stop.

FIG. 2 shows in the form of a graph the position of the setting member 9 of the electric gas pedal of FIG. 1 with respect to time. It can be noted herefrom that after the closing of the ignition switch 10 the setting time a for the determination of the lower limit of the effective desired setting range of the controller unit 3 as well as the displacement time b commence. During the displacement time b the setting member 9 is moved from any initial position in the direction towards its first end position I. After the expiration of the displacement time b the counting process at the pulse counter 20 is carried out during the effective counting time c. A following safety time d sees to it that the counting process has definitely ended before the setting time a for the determination of the upper limit of the effective desired setting range of the controller unit 3 begins. In this connection the same procedure in principle is employed. During the displacement time b' the setting member 9 moves from its lowermost position which is as close as possible to the end position I into the position which is as close as possible to the end position II. Following the displacement time b' there is again a counting time c' while the counting process takes place at the pulse counter 32, as well as a safety time d'.

After expiration of the setting time a', both the resetting time e'' and the starting time e' start to run. During the resetting time e'' the setting member again moves into its lowest position closest to the end position I so that upon the following starting process the setting member is not in a full-gas position.

During the starting time e', but only after the expiration of the resetting time e'', the starter 46 is started.

As soon as the motor is running by itself, the entire setting time A has expired and the controlling of the setting member 4 is effected in traditional fashion by the desired-value transmitter 1 via the controller unit 3.

In the construction of the invention, the pulse counters 20 and 32 are understood to input the pulse train signals to the respective convertors 21 and 33 for conversion of the frequency of the pulse train signal to a voltage.

We claim:

1. In an electric gas pedal for an automotive vehicle comprising a desired-value transmitter from which an electric desired-value signal can be fed to an electronic controller unit, a setting member controllable by electric signals of the controller unit and displaceable within a maximum possible desired setting range limited by a first and a second end position, by which setting member a displacement device displaceable within an actual setting range limited by a first end position and a second end position can be mechanically actuated via a transmission unit for control of the motor power, the improvement comprising a setting device and means for storing positions of the displacement device, and wherein the maximum possible desired setting range is greater than the actual setting range and that, in the first end position and in the second end position of the displacement device, the position of the setting member can in each case be detected by said setting device and be stored by said storing means as effective desired setting range in the controller unit.

2. The electric gas pedal as set forth in claim 1, wherein said setting member comprises an electric motor which is mechanically connected with said displacement device, and an actual-value transmitter which produces an electric signal corresponding to the instantaneous position of said displacement device.

3. The electric gas pedal as set forth in claim 1, wherein the electric motor can be driven into one end position of said displacement device and a signal corresponding to said one end position is producible by the actual-value transmitter, and that thereupon the electric motor can be driven into the second end position of the displacement device and an electric signal corresponding to said second end position is producible by the actual-value transmitter.

4. The electric gas pedal as set forth in claim 2, wherein said actual-value transmitter is a potentiometer and said electric signal is a voltage signal.

5. The electric gas pedal as set forth in claim 1, further comprising timing means for establishing setting times and wherein the detection and storage of the effective desired setting range can be effected within a given setting time A.

6. The electric gas pedal as set forth in claim 5, wherein said given setting time A constitutes a lower setting time (a) for the detection and storage of the first end position and an upper setting time (a') for the detection and storage of the second end position.

7. The electric gas pedal as set forth in claim 6, wherein the setting time A can contain a starting time (e') following the upper setting time (a') and a resetting time (e'') for returning said electric motor into said lower end position.

8. The electric gas pedal as set forth in claim 2, wherein said electric motor can be driven into said first or said second position for a time which corresponds at least to the maximum required displacement time b or b' for the displacement of said setting member from one end position into the other end position.

9. The electric gas pedal as set forth in claim 8, further comprising transmitting means for signaling end positions in the driving of said electric motor, and means in circuit with said transmitting means for measuring time, and wherein after the maximum required displacement time b or b' of the setting member during a counting time of said measuring means, the electric signal corresponding end position can be produced by said transmitting means.

10. The electric gas pedal as set forth in claim 9, wherein the counting time constitutes an effective counting time c or c' and a safety time d or d' and the counting time is greater than the maximum possible effective counting time c or c'.

11. The electric gas pedal as set forth in claim 1, wherein said setting device 11 is arranged fixed in the vehicle and is connected to the desired-value transmitter and the electric controller unit.

12. The electric gas pedal as set forth in claim 1, wherein said setting device can be switched on by the ignition switch of the vehicle.

13. The electric gas pedal as set forth in claim 1, further comprising means responsive to an engine speed for blocking said setting device during operation of an engine in the vehicle.

14. The electric gas pedal as set forth in claim 1, wherein said setting device includes means in circuit with the desired value transmitter for blocking, during the setting time of the setting device, the controllability of the electronic controller unit in response to a signal of the desired value transmitter.

15. The electric gas pedal as set forth in claim 1, wherein said setting device includes means for blocking the switching on of the starter for the engine of the automotive vehicle during a setting time in the operation of said setting device.

* * * * *